United States Patent [19]

Krieger

[11] 4,080,738

[45] Mar. 28, 1978

[54] COPYING DEVICE FOR TAILOR'S TRADE

[75] Inventor: Guenther Krieger, Lahr, Germany

[73] Assignee: Verlag Aenne Burda, Offenburg, Germany

[21] Appl. No.: 649,077

[22] Filed: Jan. 14, 1976

[30] Foreign Application Priority Data

Jan. 14, 1975 Germany ..... 2501249

[51] Int. Cl.[2] ..... B43L 13/00

[52] U.S. Cl. ..... 33/18 R; 33/41 E

[58] Field of Search ..... 33/27 C, 27 R, 27 B, 33/153 D, 153 R, 157, 41 C, 41 E, 41 F, 18 R

[56] References Cited

U.S. PATENT DOCUMENTS

| | | | |
|---|---|---|---|
| 3,039,197 | 6/1962 | Abbott | 33/137 R |
| 3,208,149 | 9/1965 | Zachs | 33/157 |
| 3,496,640 | 2/1970 | Warner | 33/15 D |

FOREIGN PATENT DOCUMENTS

| | | | |
|---|---|---|---|
| 814,649 | 3/1937 | France | 33/27 C |
| 342,964 | 10/1921 | Germany | 33/41 F |
| 905 of | 1904 | United Kingdom | 33/27 C |

OTHER PUBLICATIONS

Pub. American Machinist, 3/5/51, p. 132, Circle Scriber, etc.

*Primary Examiner*—Harry N. Haroian
*Attorney, Agent, or Firm*—Fulwider, Patton, Rieber, Lee & Utecht

[57] ABSTRACT

The present invention provides a copying device for tailor's trade, comprising a holder for a copying wheel and a holder for marking means, wherein one of said holders forms a handle portion, and wherein said holders are mounted to each other in adjustable and lockable fashion for setting a lateral spacing therebetween, wherein said holder forming said handle portion, in each operating position thereof, is disposed above said other holder, and said mounting of said holders is formed as a pivot bearing having an upright pivot axis in the operating position, and that, in order to set predetermined spacings between said copying wheel and said marking means positive engagement elements engageable upon a pressure being applied against the underlying surface, are provided between said holders.

9 Claims, 5 Drawing Figures

Fig. 1
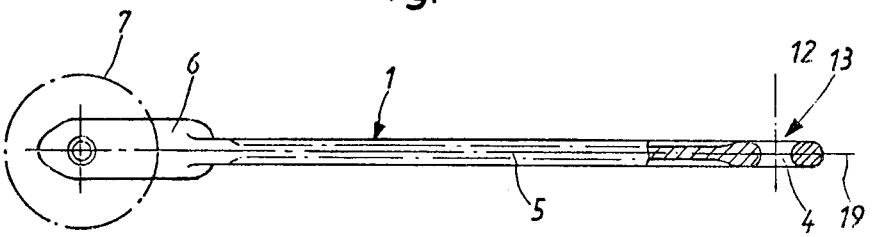
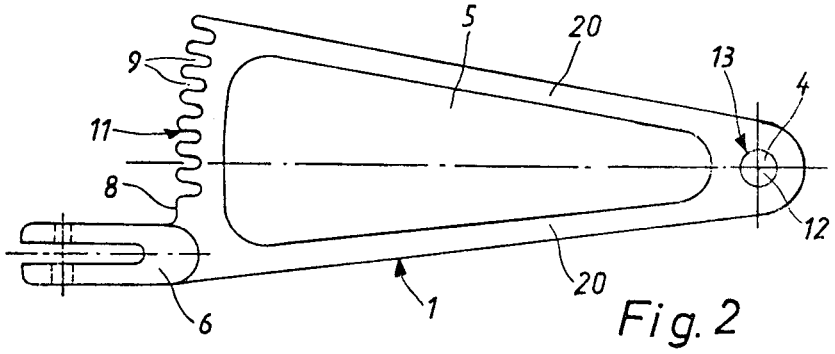
Fig. 2

COPYING DEVICE FOR TAILOR'S TRADE

SUMMARY OF THE INVENTION

The present invention relates to a copying device for tailor's trade, comprising a holder for a copying wheel and a holder for marking means, wherein one of said holders forms a handle portion, and wherein said holders are mounted to each other in adjustable and lockable fashion for setting a lateral spacing therebetween.

A copying device of this type is known, for instance, from German Pat. No. 342,964. In this conventional device, the holder for the copying wheel forms a customary elongate handle portion the head piece of which is screwed into the handle body; in this device, a transverse bar is clamped between the head piece and the handle body, which bar is angularly bent at one side and carries a writing instrument. When loosening the threaded connection between the head piece and the handle body, the transverse bar can be moved laterally and clamped again in a desired position by tightening the threaded connection between the head piece and the handle body.

Such clamping by means of a threaded connection requires a substantial force to be exerted because the clamping engagement must take up the torque resulting from the pressure force of the tailor's chalk or of the writing instrument, respectively, which force acts with a moment arm corresponding to the distance between the writing instrument and the copying wheel. This fact always causes the danger of the threaded connection becoming loose frequently, this resulting in constant trouble in operation. Add to this the fact that such clamping of the holder for the writing instrument by means of a clamping screw or threaded connection at the holder for the copying wheel requires both a threaded joint of high loading capacity and a holder for the writing instrument being resistant to bending forces. Consequently, the components cannot be produced as inexpensive mass production article, e.g. from plastic material; rather, they must be formed from relatively strong materials, particularly metallic materials. In technological respects, these materials are quite unsuitable for mass production of commodities and, besides, they are relatively expensive.

Accordingly, it is the object of the present invention to provide a copying device of the above outlined type which can be produced as an inexpensive mass production article and which is nevertheless safe in operation without requiring troublesome special care or efforts during use.

According to the present invention, this object is solved in that said holder forming said handle portion, in each operating position thereof, is disposed above said other holder, and said mounting of said holders is formed as a pivot bearing having an upright pivot axis in the operating position, and that, in order to set predetermined spacings between said copying wheel and said marking means positive engagement elements engageable upon a pressure being applied against the underlying surface, are provided between said holders. With this construction, the user, upon setting the desired spacing of the writing or marking instrument relative to the copying wheel, may lock the selected spacing by simply pressing onto the upper holder forming the handle portion, thereby effecting engagement of the positive engagement elements; accordingly, setting and locking of the adjusted position can be effected by means of a simple manipulation in the course of using the device. Hereby, the upper holder forming the handle portion supports the holder therebeneath over a wide surface area such that the resulting forces may be taken up safely even in the case of a substantial pressure being applied to the support, without causing excessive local peak loads to occur. No noticeable forces occur in the pivot bearing itself, and particularly no shear forces, such that no high strength components are required at this place, either.

If the pivot bearing, according to a preferred further development of the invention, is provided at the rear face of the holder opposite from the copying wheel and the marking instrument, then the pivot radius in setting the spacing becomes particularly great so as to avoid, on the one hand, lagging of the marking instrument relative to the copying wheel, or vice versa, in the direction of movement of the device even in the case of substantial lateral spacings, and so as to further improve, on the other hand, the supporting of the lower holder by the upper holder, and the pivot bearing is substantially fully relieved even of forces acting in the direction of the pivot axis due to the resulting increase of the length of leverage.

Preferably the marking instrument is a writing instrument. Due to the fact that the pivot bearing is not subjected to any substantial action of forces, this bearing even in the case of using inexpensive and relatively easily moldable materials may be formed, in a manner being favourable in view of production techniques, by a boss of the one holder engaging into a recess of the other holder. Of particular advantage is the fact that the arrangement may be made such that the boss resiliently engages with a snap fit into the recess in the manner of a press fastener, whereby the relatively low stability of inexpensive materials, besides, may be utilized in a functionally advantageous manner. Of course, instead of the integral boss formed at the one holder, if necessary the pivot shaft may be formed also by a separate component, and that especially when the elastic properties of the inexpensive material employed do not allow such a press fastener-type connection to be made. This press fastener-type connection or joint not only provides for simplified assembling of the device whereby the boss of the holder is simply pressed into the recess of the other holder; rather, the user is also enabled to separate or detach the two holders without any expenditure of energy, and to use them individually in case of need, as well as to re-join them quickly. Furthermore, this facilitated assembling also provides for simplification of packaging and storage because the two holders may be packaged, stored and sold in the optimum space saving position, whereby assembling of the device will be made possibly only when the device is used for the first time.

Of particular advantage is the fact that at least one of said holders, namely the holder having the boss thereon in the case of the explained further developments, is formed as a plastic molded part. This renders possible the mass production at low cost, e.g. as an injection molded article of a thermoplastic material. It is herby sufficient to form the lower holder - with the exception of a possibly provided boss or lug and of the mounting part disposed at the head for the writing instrument or the copying wheel - as a flat bar having a low moment of resistance in the direction of the pivot axis. Apart from rendering possible an easy and inexpensive production with low expense of material, this feature is also advantageous in use inasmuch as the lower holder may be resiliently bent away from the upper holder in the direction of the pivot axis such that the positive engagement elements may be engaged and disengaged in particularly easy manner.

In a most preferred embodiment of the invention said holder forming said handle portion is preferably formed as a sector-shaped plate and provided with lock notches in its edge adjacent said copying wheel or said marking means, with at least one lock projection of said lower holder engaging into said lock notches. Due to the construction of the upper holder as a plate which, if necessary, may be stiffened or reinforced by ribs, the handle portion which is subjected to bending stresses in use may be formed as an inexpensive plastic molded part, whereby the lock notches in the edge of the plate do not require any special extra expenditure in production. A particularly fine adjustment of the spacing or distance is obtained if the lock notches are formed by the gaps between the teeth of a preferably regular spur gear teeth arrangement.

Advantageously, said lower holder at the edge of said upper holder having said lock notches therein, is bent upwards in an offset portion, and said lock projection is constituted by a rib at the rear face of said offset portion. This construction results in a mutual association of the positive engagement elements at the two holders which is readily visible from above during use, and the safe insertion of the ribs into the notches without canting or the like is ensured.

A particularly advantageous feature resides in the fact that said positive engagement during their engaging movement are subjected to a compression caused by a corresponding configuration, which compression secures the engaged position by frictional contact or engagement. In this way, even if the lower holder is formed as a flat bar of extremely low bending resistance, it is avoided that the selected positive engagement is released when the device is lifted; thus, the selected setting is retained until the positive engagement is disengaged intentionally.

In the case of an offset construction of the lower holder, as explained above, such locking of the positive engagement can be effected quite easily by dimensioning the spacing between the pivot axis and the starting point of the offset of the lower holder to be slightly smaller than the spacing between the pivot axis and the base faces of the lock notches of the upper holder, such that the lock projections or ribs are wedged at the base faces of the lock notches when pressure is exerted onto the upper holder. However, shear forces are hereby applied to the pivot bearing, and, in particular, the level of the lower holder relative to the handle portion is subject to manufacturing tolerances and not secured by the abutment of the positive engagement. Therefore, for the frictional engagement lock or arresting of the positive engagement elements in the engaged position it is preferred that the thickness of the, at least one, lock projection increases in a plane perpendicular to the plane of the upper holder, such that the lock projection is pressingly engaged on both sides within the lock notch. If at least a pair of lock projections are provided, depending on the conditions of production the relative spacing between such projections in a direction normal to the plane of the upper holder, alternatively or additionally, may be increased or reduced, such that the lock notches tend to press apart or against each other the lock projections or ribs, whereby wedging is obtained. With such dimensioning of the thickness or of the spacing of the lock projections and of the width of the lock notches, manufacturing tolerances may be controlled more easily such that, in spite of the compression, a positive engagement abutment or stop of the lower holder at the upper holder may define the relative position between these holders. In case of need, it is also possible to choose the configuration of the positive engagement elements, e.g. by means of merely locally disposed enlargements or the like, in such a way that the compression in the locked terminal position of the positive engagement elements is discontinued, this resulting in manufacturing tolerances being without any significance in obtaining a defined positive engagement abutment of the two holders against each other, and the locked terminal position being secured with a certain play.

It is of particular advantage that the upper holder forming the handle portion supports the copying wheel or the writing instrument in a laterally outward position, so that the lower holder may be adjusted without impediment within the full laterally adjacent peripheral region of the upper holder. In such case, it is preferred that the upper holder forming the handle portion, is formed at least approximately symmetrically with respect to a center plane normal to the pivot axis; especially when a press fastener-type releasable pivot bearing is used, the lower holder may then be mounted to either side of the upper holder without any re-adjustment, so as to sweep with its settings the region at the left-hand side or the region at the right-hand side; respectively, of the copying wheel or of the writing instrument of the upper holder. In this way, right-handers and left-handers may choose the most suitable manner of assembling for them, and this provides for special flexibility in moving the device along a pattern disposed at the right-hand or left-hand sides, respectively.

If in this construction the upper holder forming the handle portion supports the copying wheel, the axis of rotation of the latter may be positioned in the plane of symmetry of the upper holder, too, and it is not necessary in this case to rearrange the writing instrument when displacing the lower holder from the one side of the upper holder to the other side. If the writing instrument associated with the lower holder is constituted preferably by a pen or stylus having a core of tailor's chalk, this results in the additional advantage that the offset portion of the lower holder serves to securely engage the pen or stylus at its shaft above the writing tip if such tip is to be prevented from protruding in downward direction beyond the periphery of the adjacently disposed copying wheel. When a pen or stylus is associated, as the writing instrument, to the lower holder, the offset portion of the lower holder thus serves both to securely mount this holder and to facilitate adjustment or setting by means of one or more ribs as lock projections at the rear face of the offset portion. Especially in the case of a single rib or of a, for example, color marked rib at the rear of the offset portion, it is found to be advantageous if the upper holder includes spacing markings associated with said positive engagement elements adjacent to the positive engagement elements preferably on both sides thereof, which spacing markings allow to definitely appoint each locked or stop position of the lower holder to a specific adjusted spacing between the writing instrument and the copying wheel.

Further details, features and advantages of the present invention are apparent from the following description of a preferred embodiment by referring to the accompanying drawings, wherein:

FIG. 1 is a side elevational view of the upper holder of a copying device according to the present invention, partly in section;

FIG. 2 is a plan view of the upper holder of FIG. 1;

Figure 3:
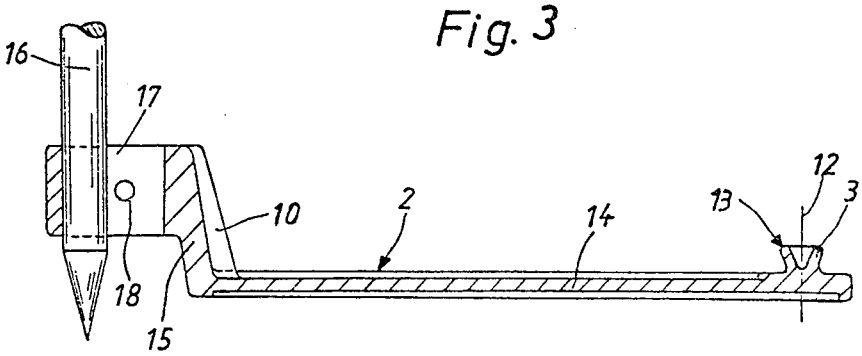
FIG. 3 is sectional side elevational view of the lower holder, similar to FIG. 1.
Figure 4:
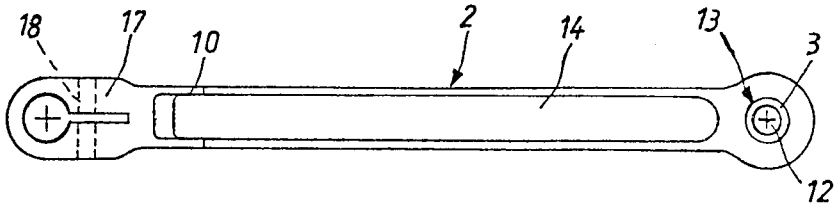
FIG. 4 is a plan view of the lower holder of FIG. 3.

In order to clearly illustrate all details of the parts of a copying device according to the present invention, the components of this device, namely an upper holder 1 and a lower holder 2, are shown separately in the drawing in identical scales. The side elevational view of an assembled copying device of the construction according to the invention is obtained when the upper holder 1 in the showing of FIG. 1 is placed from above upon the lower holder 2 as illustrated in FIG. 3, in such a way that a boss or lug 3 of the lower holder 2 and forming a pivot axis passes through a correspondingly mating recess 4 of the upper holder 1.

The upper holder 1 is formed as a substantially sector-shaped plate 5 of plastic material, which plate includes a lug 6 for the mounting of a copying wheel 7 indicated in dash-dot lines only in FIG. 1. The lug 6 is provided in eccentric position at one side of plate 5. At the edge 8 adjacent to the lug 6 or the copying wheel 7, respectively, the plate 5 forming the upper holder 1 is provided with lock notches 9 which together with a corresponding lock projection or rib 10 of the lower holder 2 define positive engagement elements for securing the relative position of the two holders 1 and 2, in a manner still to be explained below. In order to provide a maximum number of adjacently disposed engagement positions of the lock projection(s) 10 within the lock notches 9, the latters are formed, as shown in FIG. 2, as the gaps between the teeth of a regular or uniform spur gear arrangement.

The edge 8 of the plate 5 forming the upper holder 1 is curved, whereby the center of curvature is defined by a pivot axis 12 of a pivot bearing 13 formed by the boss 3 of the lower holder 2 and the recess 4 of the upper holder 1. When the boss 3 of lower holder 2 is inserted into the recess 4 of upper holder 1 for assembling the copying device according to the invention, the radially outer edges of the, as shown in FIG. 3, cup-shaped or flared boss 3 are compressed so as to resiliently engage with a snap fit into the inner edge of recess 4. This design provides a pivot bearing 13 formed similarly to a press fastener joint which is most easy to assembly and disassemble both during manufacture and in use of the present copying device, such that the holder 2 including the writing instrument 16 may be arranged either at the left-hand side or at the right-hand side of the copying wheel 7.

The lower holder 2 is formed essentially as a flat bar 14 which after assembly flatly abuts the plate 5 forming the upper holder 1 from the one or the other side of said upper holder 1. Due to the fact that the low moment of resistance of the flat bar 14 is disposed in the direction of the pivot axis 12, the flat bar 14 may be bent away from plate 5 without effort and danger of breakage as well as without any substantial stress exerted upon the pivot bearing 13. In this manner, the lock projections formed as ribs at the rear face of an offset portion 15 of the flat bar 14 and which engage into the lock notches 9 when the flat bar 14 contacts plate 5, and disengaged from the lock notches 9, and the flat bar 14 may be rotated relative to the plate 5 about the pivot axis 12. When the flat bar 14 forming the lower holder 2 is released, this flat bar over its full length resiliently returns into at least approximate contact with the adjacent side of the upper holder 1, whereby the ribs forming the lock projections 10 at the rear face of the offset portion 15 engage with a lock notch 9 corresponding to the selected angular position. In the illustrated example, a single rib is provided as a lock projection 10 at the flat bar 14 forming the lower holder 2, this being sufficient for providing a positive engagement lock or latch of the relative angular position between the two holders 1 and 2 and, besides, permitting to clearly read the spacing of the copying wheel 5 from a marking device 16 attached to the lower holder 2, corresponding to the pivot or angular position, if in a manner not shown in greater detail corresponding markings, forming a scale, are provided adjacent to the lock notches 9 in the face(s) of plate 5 forming the upper holder 1.

Figure 5:
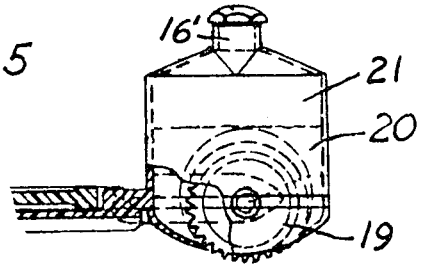
FIG. 5 is an enlarged sectional view of an alternative writing instrument to that depicted in FIG. 3.

The offset portion 15 of the flat bar 14 joins a clamping portion 17 which, in the illustrated embodiment, is formed integrally with the flat bar 14 and wherein the writing instrument 16, a pen or stylus in the example shown in FIG. 3, may be clamped. In order to provide for secure location of the pen within the clamping portion 17, the clamping portion 17 may be provided with a transverse bore through which a clamping screw tightened by a counter nut passes in a manner not shown in greater detail. As shown, the offset portion 15 permits the pen or stylus forming the writing instrument to be positively grasped at its shaft above its tip without thereby bringing its writing tip into a writing position below the rolling surface of the copying wheel 7. An alternative writing instrument to the marking device 16 of FIG. 3 is depicted in FIG. 5. In the place of a pen or stylus by means of which a clear marking is difficult to obtain mainly in the case of coarse fabrics which may tend to catch the pen or stylus, there may be provided also a dusting device 16′ or the like in which, for instance, an applicator wheel receives a dye in powderous form from a reservoir 21 and applies such dye 20 upon the underlying material, whereby the dye 20 may be present in cartridges. In such case, the clamping portion of 17 of FIG. 3 is replaced by a cartridge retainer or a reservoir 21 which may join the offset portion 15, too.

The dead weight forces affecting the marking means 16 and the clamping portion 17 at the flat bar 14 are spaced by a substantial distance from its mounting at the plate 5 forming the upper holder 1 within the pivot bearing 13, which latter is arranged at the end of holders 1 and 2 opposite from the writing instrument 16 and the copying wheel 7. In order to prevent the flat bar 14, which is always disposed beneath plate 5, from being deflected in lifting off the copying device from the underlying surface, to such degree that the lock projection 10 is unintentionally disengaged from the selected lock notch 9, the positive engagement connection to the positive engagement elements 11 may be additionally secured by frictional contact or engagement in the engaged position. To this end, the spacing between the boss 3 and the rear face of the offset portion 15, adjacent the upper face of the flat bar 14, could be dimensioned to be slightly smaller than the spacing between the base faces of the lock notches 9 and the recess 4 or the pivot axis 12, respectively, such that, when the copying device is pressed against the underlying surface, the flat bar 14 is clamped between the recess 4 and the lock notches 9. Likewise, the rib forming the lock projection 10 may have a thickness increasing towards the flat bar 14 such that, when the flat bar 14 is pressed against the plate 5 from below, a compression of the rib within the associated lock notch 9 is effected. The same effect can be obtained in the case of two or more ribs as lock projections 10, also by a corresponding variation of the relative spacing of the ribs, whereby the ribs forming the lock projections 10 are pressed either apart or against each other when engaged into the lock notches 9. In order to ensure that in each case the rolling surface of the copying wheel 7, preferably formed as a serrated wheel, is positioned as precisely as possible at the same level as the tip of the writing instrument 16 or the applicator position of an applicator wheel or the like, the selection of the spacing between the pivot axis 12 and the rear face of the offset portion 15, or between a pair of lock projections, or the corresponding selection of the thickness of an individual lock projection 10, resulting in a compression of the components, may be made only for contact surfaces extending to a point adjacent to a terminal lock position such that, when the lower holder 2 is brought closer to the upper holder 1, the compression is released again and a facial contact of the flat bar 14 with plate 5, regardless of existing tolerances, is ensured.

As shown in FIG. 1, the upper holder 1 is formed symmetrically with respect to its center plane 19 extending normal to the pivot axis 12. The copying wheel 7, too, is mounted in the center plane 19 so as to be symmetrical relative to this plane. This arrangement renders possible the use of the upper holder 1 both in the position shown in FIG. 2 and in a position rotated by 180°, whereby the lower holder 2 in each case contacts the lower face of plate 5 without variation, in the position shown in FIG. 3; to this end, it is only necessary to withdraw the boss 3 from the recess 4 and to reinsert it from the other side. Other changes, such as e.g. rearrangement of the writing instrument 16, are not necessary. In view of the symmetrical construction of the upper holder 1, also relative to the copying wheel 7, the adjusted level of the writing tip of the writing instrument 16 relative to the rolling surface of the copying wheel 7 is maintained also in the position of the plate 5 reversed by 180°. However, the writing instrument or marking device 16 is at the right-hand side of the copying wheel 7 in the position of the plate 5 as shown in FIG. 2, while this device, same as edge 8, is at the left-hand side of the copying wheel when plate 5 is reversed by 180°. This provides for ready adaptation to various conditions of the respective use, and the relative position of the copying wheel 7 and the writing instrument 16 can be chosen in dependency of the hand by which the present copying device is guided. Both plate 5 of upper holder 1 and flat bar 14 of lower holder 2 can be manufactured economically in mass production as simple plastic molded parts. By forming the upper holder 1 as a plate 5 which, if necessary, may be reinforced by ribs 20, this holder has sufficient stability for every application. The flat bar 14 of lower holder 2 is supported with its full length by the lower face of plate 5 such that it does not require any inherent stiffness or stability; on the contrary, a construction of the flat bar 14 so as to be weak or slack to bending, in advantageous manner renders possible easy disengagement of the positive engagement between the lock projection 10 and a lock notch 9, whereby the positive reengagement, upon pivoting of the lower holder 2 into the desired angular position, is effected either automatically by spring-back of the flat bar 14 or upon pressing the copying device against the underlying surface, and such engagement may be secured in case of need by means of frictional press contact. This ensures optimum operating reliability and ready manipulation of the copying device in which re-adjustments of the spacing between the copying wheel 7 and the writing instrument 16 can be effected with the finger of a hand in seconds, whereby such spacing is positively maintained until a new spacing is set.

What is claimed is:

1. A tailor's copying device of the type including an elongated copying wheel holder including a lug adapted to receive a copying wheel and an elongated marker holder and wherein one of said holders forms a handle portion and said holders mounted to each other and are relatively rotatable in mutually parallel planes both perpendicular to the orientation of said copying wheel and in adjustable and lockable fashion for setting a lateral spacing therebetween, and wherein said marker holder includes means for carrying a marker oriented perpendicular to the parallel planes or relative rotation of said copying wheel holder and said marker holder and wherein said marker includes a dusting device for applying a powderous marking material the improvement comprising:

mounting means mounting said copying wheel holder in coextensive relationship over said marker holder and including a bearing boss projecting upwardly from one extremity of said marker holder and a mating recess formed in one extremity of said copying wheel holder for fitting over said bearing boss, said mounting means further including a longitudinally projecting locking rib formed at the extremity of said marker holder opposite said one extremity and a plurality of transversely spaced apart locking notches formed in the extremity of said copying wheel holder opposite said one extremity and each selectively engagable with said locking rib to cooperate with said bearing boss and mating recess to lock said holders relative to one another.

2. A tailor's copying device according to claim 1 wherein:

said bearing boss is in the form of a resilient upwardly projecting outwardly flared bearing and said recess is formed in cross section to slightly compress the free extremity of said bearing to thus snap fit thereonto.

3. The copying device according to claim 1 wherein: at least one of said holders is formed as a plastic molded part.

4. The copying device according to claim 1 wherein: said marker holder is formed by a flat bar having a low moment of resistance in the direction of said boss.

5. The copying device according to claim 1 wherein: said marker holder is bent upwards at the extremity of said copying wheel holder remote from said bearing boss to form an offset portion adjacent to said lock notches and said lock rib is formed on said marker holder at the rear face of said offset portion.

6. The copying device according to claim 1 wherein:

said notches and rib are constructed in a mating configuration and during their engagement, are subjected to a compression caused by elastic bias of said mounting holder and said copying wheel holder toward each other at extremities thereof remote from said bearing boss and said mating recess, which compression secures the engaged position against relative movement perpendicular to said mutually parallel planes by frictional contact.

7. The copying device according to claim 1 wherein: said copying wheel holder forms said handle portion and supports said copying wheel in a laterally outward position.

8. The copying device according to claim 2 wherein: said copying wheel holder forms said handle portion and is configured to be at least approximately symmetrical relative to a center plane extending longitudinal of said copying wheel holder and perpendicular to the orientation of said copying wheel.

9. The copying device according to claim 1 wherein said marker includes an applicator wheel and a reservoir positioned proximately thereto, whereby a dye in powderous form may be drawn from said reservoir for application by said applicator wheel.

* * * * *